US009126420B2

(12) United States Patent
Heath et al.

(10) Patent No.: US 9,126,420 B2
(45) Date of Patent: Sep. 8, 2015

(54) MULTI-LAYER PRINTING ON NON-WHITE BACKGROUNDS

(71) Applicant: ELECTRONICS FOR IMAGING, INC., Foster City, CA (US)

(72) Inventors: Peter Heath, Alexandria, NH (US); Dwight Cram, Concord, NH (US); Bryan Ko, Palo Alto, CA (US); Joseph A. Lahut, Moultonboro, NH (US)

(73) Assignee: Electronics for Imaging, Inc., Fremont, CA (US)

( * ) Notice: Subject to any disclaimer, the term of this patent is extended or adjusted under 35 U.S.C. 154(b) by 0 days.

(21) Appl. No.: 13/909,854

(22) Filed: Jun. 4, 2013

(65) Prior Publication Data

US 2014/0354726 A1 Dec. 4, 2014

(51) Int. Cl.
*B41J 2/01* (2006.01)
*B41J 2/21* (2006.01)

(52) U.S. Cl.
CPC ..... *B41J 2/2117* (2013.01)

(58) Field of Classification Search
CPC ..... B41J 2/2117
See application file for complete search history.

(56) References Cited

U.S. PATENT DOCUMENTS

| | | | | |
|---|---|---|---|---|
| 2002/0089686 | A1 | 7/2002 | Kitahara et al. | |
| 2007/0067928 | A1 | 3/2007 | Ellis | |
| 2007/0104899 | A1 * | 5/2007 | Pearl et al. | 428/32.24 |
| 2007/0188535 | A1 | 8/2007 | Elwakil et al. | |
| 2008/0248405 | A1 | 10/2008 | Almanza-Workman et al. | |
| 2009/0207458 | A1 * | 8/2009 | Doggett et al. | 358/3.29 |
| 2011/0141173 | A1 | 6/2011 | Usuda et al. | |

* cited by examiner

*Primary Examiner* — Julian Huffman
(74) *Attorney, Agent, or Firm* — Michael A. Glenn; Perkins Coie LLP

(57) ABSTRACT

In a multi-layer printer, the base white layer that is applied during printing is modified using the image to be printed. By altering the white layer to reflect the density of the top image, it is easier to reach saturation (density/gamut) without adding large amounts of ink. Thus, such undesirable side effects, such as gloss-banding are avoided.

13 Claims, 3 Drawing Sheets

MULTI-LAYER PRINTING ON NON-WHITE BACKGROUNDS

BACKGROUND OF THE INVENTION

1. Technical Field

The invention relates to printing. More particularly, the invention relates to a multi-layer printing with enhanced saturation.

2. Description of the Background Art

Inkjet printing is a type of computer printing that creates a digital image by propelling droplets of ink onto paper. Inkjet printers are the most commonly used type of printer, and range from small inexpensive consumer models to very large professional machines that can cost tens of thousands of dollars.

The concept of inkjet printing originated in the 19th century, and the technology was first extensively developed in the early 1950s. Starting in the late 1970s inkjet printers that could reproduce digital images generated by computers were developed, mainly by Epson, Hewlett-Packard (HP), and Canon. In the worldwide consumer market, four manufacturers account for the majority of inkjet printer sales: Canon, HP, Epson, and Lexmark, a 1991 spin-off from IBM.

The emerging ink jet material deposition market also uses inkjet technologies, typically print heads using piezoelectric crystals, to deposit materials directly on substrates.

When using standard process colors to print onto non-white or colored media the typical approach is to print a white layer, then print color on top. For example Vutek's PressVu 200/QS/GS/HS series printers all have multilayer capabilities for printing on clear and colored media.

Printing onto a known solid bright white layer yields consistent results, but requires a certain ink density to reach saturation. However, increased ink density is known to contribute to gloss-banding. Thus, increasing the white ink density is not a satisfactory approach to compensating for a non-white medium.

SUMMARY OF THE INVENTION

An embodiment of the invention modifies the base white layer applied to non-white or colored media by printing and curing the white layer with a portion of the colored ink of the image to be printed. By altering the white layer to reflect the density and/or saturation of the image itself, it is easier to reach saturation (density/gamut) without adding large amounts of ink to compensate for the cast of the underlying media. Thus, image quality is increased, while undesirable side effects, such as gloss-banding, are avoided.

DETAILED DESCRIPTION OF THE INVENTION

An embodiment of the invention modifies the base white layer applied to non-white or colored media by printing and curing the white layer with a portion of the colored ink of the image to be printed. By altering the white layer to reflect the density and/or saturation of the image itself, it is easier to reach saturation (density/gamut) without adding large amounts of ink to compensate for the cast of the underlying media. Thus, image quality is increased, while undesirable side effects, such as gloss-banding, are avoided.

Figure 1:
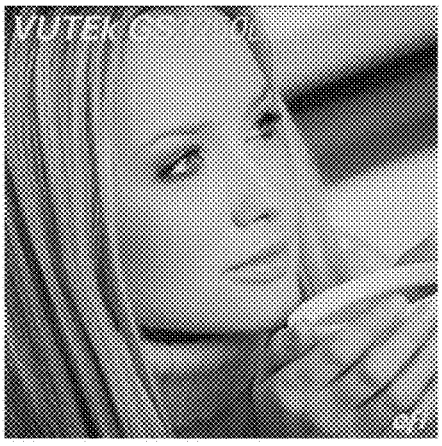
FIG. 1 shows an original image that is to be printed.
Figure 2:
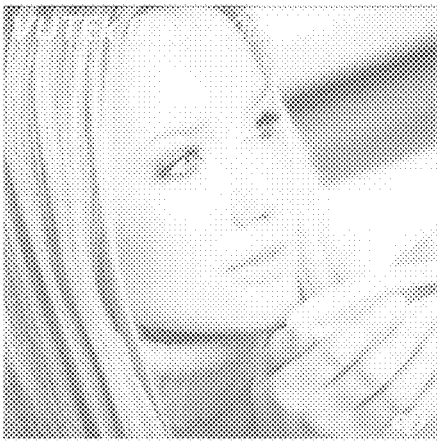
FIG. 2 shows a white layer onto which the image of FIG. 1 is added during printing of the white layer according to the invention.

FIG. 1 shows an original image that is to be printed. In an embodiment, a lightness (L) percentage (1-100%) of the image to be printed is added directly into the white layer while it is being printed (wet). Thus, the white ink and a portion of the colored ink that makes up the actual image merge and are cured together. See FIG. 2. While the image itself is not substantially visible in the white layer after the white layer is printed, images printed in this manner show increased color density without detail loss from the use of more pixels in the final printed image.

In an embodiment of the invention, when printing onto a non-white or colored substrate, the printer simultaneously applies a layer of white and colored ink, where the colored ink is applied at a predetermined density because it has white ink below it and a further colored ink layer on top of it. An embodiment of the invention analyzes the image. In an embodiment of the invention, a typical profiling process, as used in a standard printing process, can be applied to the printer output produced using the herein disclosed techniques. For example, a sample image, usually comprising blocks or gradients, is printed in a linear mode with no adjustments, using only the native output of the printer. The printed sample is then measured with a densitometer or spectrophotometer to create a profile. The printer output is then adjusted to reflect the desired output, rather than the native output. For example, when the printer's native output for a 75% density request is to print 80% density, the profiled image requests less than 75% density when it wants 75% actual printed density.

At the densest spots of the image, effectively less white ink is applied by adding colored ink for the image on a bottom layer along with the white ink. Thus, the image looks richer on top, i.e., more saturated. The entire image is printed and the amount of the image, i.e. the density of the image itself that is added underneath, is determined by an adjustment. The image is always the same image, whether the user adds 100% of the density or a smaller or larger amount, based the substrate that the image is printed on.

Non-white and colored media are very popular; some examples include:

- Colored Sintra—An expanded PVC that is popular in strong solid colors; these colors need the most white-ink opacity. Also available under different brand names.
- Colored card stock available in any color.
- Colored paper—Uncoated, it absorbs more ink, making it more difficult to reach saturation densities. Having the extra color in the first layer can help.
- Lexan and PETG—These are popular clear materials; they benefit from the herein disclosed techniques because they are clear and are, therefore, often situated in places where the backlighting changes, e.g. in a window, from sunshine to dark, etc.

To adjust the density, in an embodiment of the invention, the operator of a printer adjusts the amount of white and colored ink applied by the ink jets of each print head through a software implemented control mechanism which, based upon operator and/or profile settings, determines how much of the image to print during a first pass, when the printer is printing the white ink, and how much of the image to print during one or more subsequent passes. When the white ink is combined with a portion of the image, a percentage of 100% of the overall density of the image, as defined by the combined total amount of all inks applied to the media to print the image itself, is applied to the substrate and, in an embodiment of the invention, a second part of the colored ink used to print the image is subsequently applied to the substrate, resulting in 100% of the colored ink used to print the image being applied to the substrate. In other embodiments of the invention, the total amount of colored ink applied to the substrate can be set to be more or less than 100% of the colored ink that would be applied to print the image if the invention herein were not used.

Because some colored ink is applied with the white ink and because 100% of the is image is applied, an embodiment of the invention provides a mechanism for determining how much colored ink is mixed with the first layer, i.e. some percentage of 100%, or more or less than 100%, if desired. For example, a first pass could apply 20% of the colored ink used to print the image to the substrate. In this case, 100% of the white ink is applied along with 20% of the colored ink used to print the final image. In the second step of the process, 100% of the white ink has already been applied and 100% of the colored ink is applied, resulting in 120% of the image intermixed and on top of the white ink. This provides enhanced saturation, which would make the image stand out better over the non-white media on which it is printed.

The determination of how much of the colored ink used to print the image to apply at each step can be made and stored in a profile or the operator can be given a control to vary the amount of the colored ink that is applied during the first pass versus the second (and any subsequent) pass. In an embodiment of the invention, there is a slider, a numerical value, a table, or other control with which the operator sets the printer to print 5%, 10%, 15%, 20%, etc., of the colored ink used to print the image with the white ink, and then 100% of the colored ink used to print the image on top of that. In some embodiments of the invention there is a default to a predetermined value, which is preferably a high value because the white ink is so opaque that it diffuses the color quickly. It should also be noted that the image does not appear when it is first printed with the white ink. The image is only visible in most cases in the second pass and/or subsequent passes.

Another aspect of the invention concerns dot-gain, as well as enriching the image. In many cases, it is important to get image to look as if it was printed on a white substrate without a base application of white. In this embodiment, the operator takes a test pattern, e.g. CMYK, prints that pattern onto a standard substrate, and measures the color values. The operator then takes the same substrate, prints white ink on it using the herein disclosed invention, and prints the image on top of the white ink layer to determine what was lost by applying the white ink to the image. This aspect of the invention thus concerns a method for determining how much extra color to apply to print the desired image on a substrate having a white ink base applied thereto. In this embodiment of the invention, the same substrate is then printed as a two-layer print with white ink first and then the colored ink used to print the image. In this case, the image is not as dense as when image printed onto the substrate. To compensate for this, the invention is used to apply extra colored ink for the image, e.g. add 20%.

When printing using the herein disclosed techniques, it is possible to use less colored ink on the top layer and achieve the same visual density because the added density comes from the bottom (color-white) layer. The profiling process is used, as set forth above, to profile the image so that it has the same final appearance as an image printed in only one layer or on a solid white flood layer. Because profiled images in accordance with the invention have less ink in the top layer to achieve the same density, on average less ink is deposited in every print pass. Because less ink is applied per pass, each ink drop is less prominent, and there is a resulting reduction in gloss-banding or tire-tracking that occurs when adjacent ink drops merge. That is, as more ink is applied in a pass, there is liquid-to-liquid interaction before the substrate goes under a pinning lamp or a curing lamp, and this produces the gloss banding or tire tracking artifact. This aspect of the invention minimizes gloss banding or tire tracking artifacts. Further, with the invention the same amount of ink may be used as is used in other printing techniques, but with a result that a more a vibrant image can be printed without the risk of gloss banding.

Further embodiments of the invention provide an image enhancement button that, when pushed, causes the printer to default to a predetermined percentage split between the first and second pass for the colored ink, where the operator can have an ability to adjust beyond that setting, e.g. to add more density as part of a print management tool.

In an embodiment of the invention, other effects, such as gloss can be added to the image and the operator can see how it would look on the print, e.g. by operation of a slider bar which the operator can click and drag across an image to see and compare an enhanced image, i.e. an image with more than 100% colored ink and/or other effects, such as gloss, versus the non-enhanced image. In this regard, an embodiment of the invention may provide two or more operator controls, e.g. where one control adjusts the split for application of colored ink between the first print, with the white ink and the second, final print; and where the other control adjusts whether the density is enhanced, i.e. whether the total amount of colored ink is greater than 100%. In such embodiments, the user interface would simultaneously display before and after images to the operator before the operator prints the image.

It should be noted that adding more than 100% of the image colored ink as the sum of the two layers, adds density. Thus, the invention allows an operator to print an image at a higher density than that which is in the image file itself, e.g. to have an even more bold background on which to lay the final image.

A further embodiment of the invention allows for reducing the second pass of color density below 100%, based on the fact that part of the image has already been applied. This aspect of the invention provides additional benefit in reducing gloss banding because the printer is not applying as much ink in a single pass. In this case, the printer applies the same masking technique to the top image as is provided by the profile when base color is set. If this impacts the profile by making the image too dense, then the profile is adjusted to cut the color back.

Figure 3:
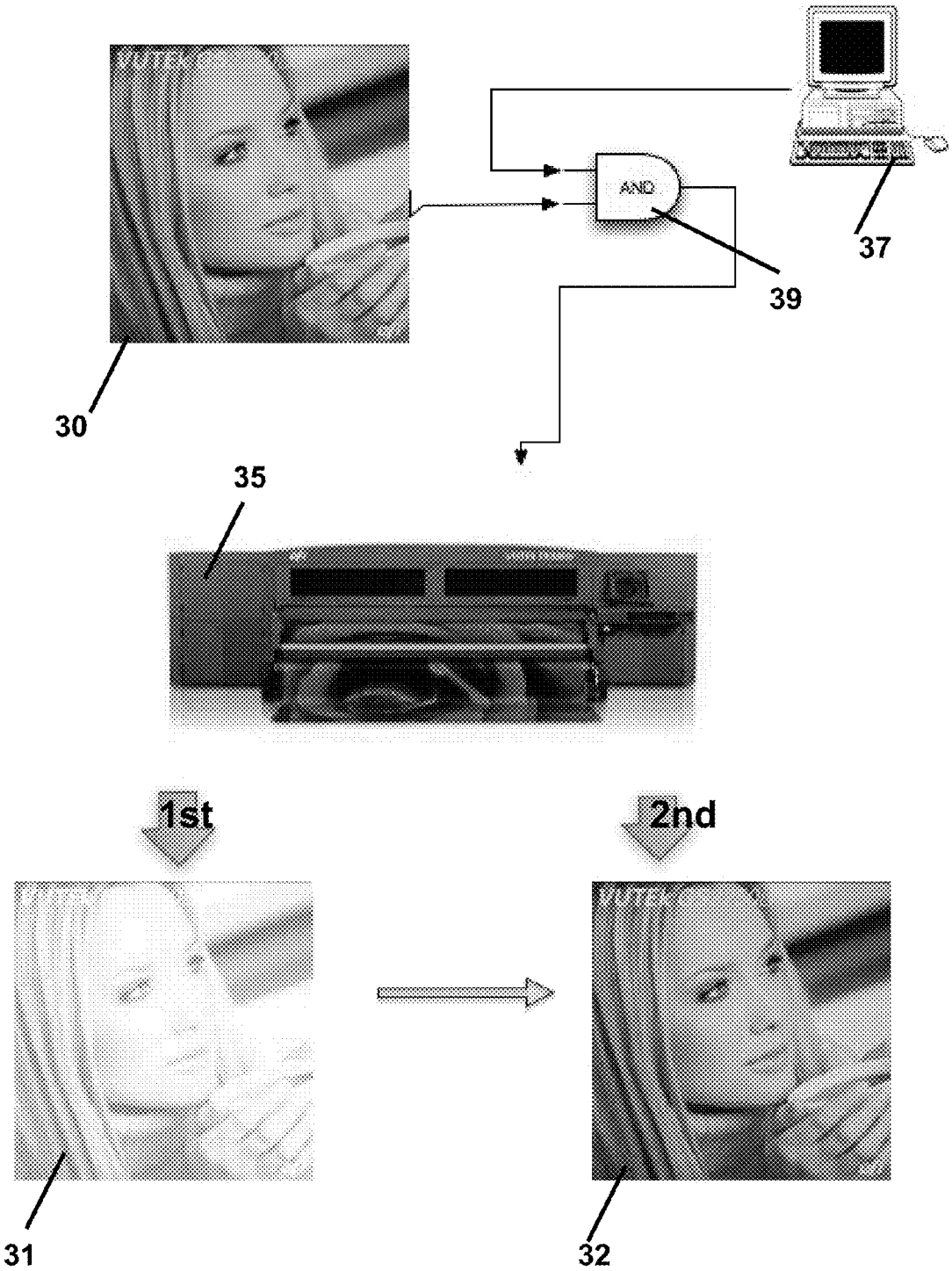
FIG. 3 is a schematic representation of a method for multi-layer printed on non-white backgrounds according to the invention.

FIG. 3 is a schematic representation of a method for multi-layer printing on non-white backgrounds according to the invention. In FIG. 3, the source image 30 is processed for printing, for example in a raster image processor (RIP) 39. A workstation 37 provides a user interface to operate the RIP. Additionally, the workstation can provide user controls for adjusting the percentage of the top image that is added directly into the white layer. The percentage can be adjusted, for example by adjusting the lightness (L) of the image in the L*a*b* color space. Thus, the first pass of the printer may print a white layer and a percentage, e.g. 20%, of the color layer in the image; while a second pass of the printer prints the remaining, e.g. 80%, of the color layer of the image.

In some embodiments, both passes may print more or less than 100% of the color layer, as desired for a particular result. Thus, the workstation may also provide previews of the resulting print and preset percentages. The printer 35 receives the image information and commands that operate the white and color print heads to effect printing of white ink and the top image at the same time. This results is a first image 31 being formed on the substrate. Thereafter, the remaining percentage of the top image is printed over the base image, resulting in the final printed image 32.

Another embodiment of the invention uses only black or light black in the white layer based on the color intensity (L) of the top image. This compromise method saves ink, but does not, in some cases, provide the full range of saturation improvement that matching color does. Using only the black inks saves on ink because black inks appear much darker when mixed with white. This works very, well for saturation in shadows or dark areas, but it does not help saturation in highlight areas, e.g. it cannot make a sunny area look brighter, as a yellow ink could. However, this approach is a good compromise because highlight areas tend to have less ink use and rely on the white for their brightness.

Further, while density and/or saturation of the overall image can be adjusted using the techniques discussed above, the invention is also applicable to selected areas of the image. Thus, a portion of the colored ink that is to be applied to print the image can be printed with the white layer for certain areas of the substrate, such as under a photo, where a specific density and/or saturation or effect related to density and/or saturation is desired. The user interface can provide a graphic tool with which the user can define these areas prior to printing, and with which the user can assign desired density and/or saturation to such areas. For example, the user may decide to print 60% of the colored ink portion of the image with the white layer at each place in the image where a photograph appears, 40% of the colored ink portion of the image with the white layer at each place in the image where a graphic appears, and 0% of the colored ink portion of the image with the white layer at each place in the image where text appears.

Further, while the invention herein contemplates altering the density and/or saturation of the image printed in each of multiple print passes by printing a percentage of the colored ink with the white ink and a percentage of the colored ink afterward, i.e. when printing the colored ink layer with the white ink layer and when printing only the colored ink layer, where the total amount of colored ink applied is some percentage of the total colored ink that would otherwise be applied, the invention also contemplates using the herein disclosed technique to after the native density and/or saturation of the image by adjusting the percentage of colored ink applied in a first pass vs. the percentage of colored ink applied subsequently, adjusting the total amount of colored ink applied relative to 100% of colored ink that would be applied when the invention is not used, and adjusting the number of passes in which the colored ink is applied. Thus, the white layer and a portion of the colored ink of the image are applied together, merge, and are cured together; and the remaining portion of the colored ink is applied over multiple subsequent passes.

Computer Implementation

Figure 4:
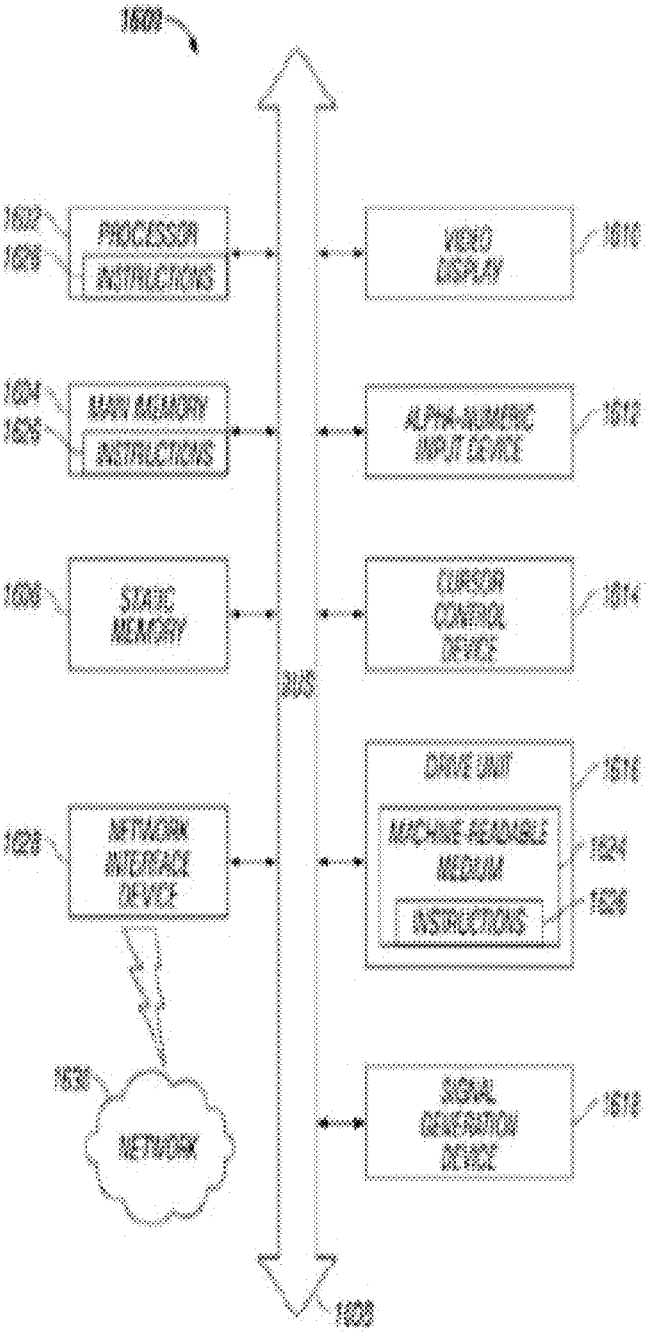
FIG. 4 is a block schematic diagram that depicts a machine in the exemplary form of a computer system within which a set of instructions for causing the machine to perform any of the herein disclosed methodologies may be executed.

FIG. 4 is a block schematic diagram that depicts a machine in the exemplary form of a computer system 1600 within which a set of instructions for causing the machine to perform any of the herein disclosed methodologies may be executed. In alternative embodiments, the machine may comprise or include a network router, a network switch, a network bridge, personal digital assistant (PDA), a cellular telephone, a Web appliance or any machine capable of executing or transmitting a sequence of instructions that specify actions to be taken.

The computer system 1600 includes a processor 1602, a main memory 1604 and a static memory 1606, which communicate with each other via a bus 1608. The computer system 1600 may further include a display unit 1610, for example, a liquid crystal display (LCD) or a cathode ray tube (CRT). The computer system 1600 also includes an alphanumeric input device 1612, for example, a keyboard; a cursor control device 1614, for example, a mouse; a disk drive unit 1616, a signal generation device 1618, for example, a speaker, and a network interface device 1628.

The disk drive unit 1616 includes a machine-readable medium 1624 on which is stored a set of executable instructions, i.e., software, 1626 embodying any one, or all, of the methodologies described herein below. The software 1626 is also shown to reside, completely or at least partially, within the main memory 1604 and/or within the processor 1602. The software 1626 may further be transmitted or received over a network 1630 by means of a network interface device 1628.

In contrast to the system 1600 discussed above, a different embodiment uses logic circuitry instead of computer-executed instructions to implement processing entities. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with CMOS (complementary metal oxide semiconductor), TTL (transistor-transistor logic), VLSI (very large systems integration), or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

It is to be understood that embodiments may be used as or to support software programs or software modules executed upon some form of processing core (such as the CPU of a computer) or otherwise implemented or realized upon or within a machine or computer readable medium. A machine-readable medium includes any mechanism for storing or transmitting information in a form readable by a machine, e.g., a computer. For example, a machine readable medium includes read-only memory (ROM); random access memory (RAM); magnetic disk storage media; optical storage media; flash memory devices; electrical, optical, acoustical or other form of propagated signals, for example, carrier waves, infrared signals, digital signals, etc.; or any other type of media suitable for storing or transmitting information.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A computer implemented method for multi-layer printing on non-white backgrounds, comprising:

in a first printer pass, modifying a base white layer with an image to be printed by adjusting application by said printer of said white layer to include substantially simultaneous application of said image's ink at a predetermined density that corresponds to a selected portion of a total amount of ink to be applied for said image; and in at least one subsequent printer pass, applying with said printer said image's ink at a predetermined density that corresponds to a remaining portion of the total amount of ink to be applied for said image.

2. The method of claim 1, said modifying comprising:

adding a lightness (L) percentage (1-100%) of said image directly into said white layer, while it is being printed (wet).

3. The method of claim 1, further comprising:

providing a control for an operator of said printer to adjust an amount of the total amount of ink to be applied for said image during said first printer pass, when said printer is printing said white layer, and to adjust the total amount of ink to be applied for said image during said at least one subsequent printer pass.

4. The method of claim 3, wherein said control provides one or more preset values with which an operator of said printer adjusts an amount of the total amount of ink to be applied for said image during said first printer pass, when said printer is printing said white layer, and adjusts the total amount of ink to be applied for said image during said at least one subsequent printer pass.

5. The method of claim 3, further comprising:

before printing said image, providing a preview display of said image as it would appear when printed in accordance with a current setting of said control.

6. The method of claim 3, further comprising:

providing one or more additional controls for adjusting said image.

7. The method of claim 1, further comprising:

providing a control for adjusting said selected portion of a total amount of ink to be applied for said image during said first printer pass and said remaining portion of the total amount of ink to be applied for said image during said at least one subsequent printer pass to equal any of more than, less than, or exactly 100% of the total amount of ink to be applied for said image.

8. The method of claim 1, wherein said selected portion of a total amount of ink to be applied for said image during said first printer pass and said remaining portion of the total amount of ink to be applied for said image during said at least one subsequent printer pass equals 100% of the total amount of ink to be applied for said image.

9. The method of claim 1, wherein said selected portion of a total amount of ink to be applied for said image during said first printer pass and said remaining portion of the total amount of ink to be applied for said image during said at least one subsequent printer pass is greater than 100% of the total amount of ink to be applied for said image.

10. The method of claim 1, wherein said selected portion of a total amount of ink to be applied for said image during said first printer pass and said remaining portion of the total amount of ink to be applied for said image during said at least one subsequent printer pass is less than 100% of the total amount of ink to be applied for said image.

11. The method of claim 1, wherein a value for an amount of how much ink to be applied for said image during said first printer pass and said remaining portion of the total amount of ink to be applied for said image during said at least one subsequent printer pass is stored in a profile.

12. An apparatus for multi-layer printing on non-white backgrounds, comprising:

a processor for processing a source image for printing;

a user interface for operating said processor, said user interface comprising user controls for adjusting a percentage of an image that is added directly into a white layer by a printer during a first pass of said printer;

wherein in said first printer pass, said white layer is modified with said image to be printed by adjusting application by said printer of said white layer to include substantially simultaneous application of said image's ink at a predetermined density that corresponds to a selected portion of a total amount of ink to be applied for said image; and wherein in at least one subsequent printer pass, said image's ink is applied with said printer at a predetermined density that corresponds to a remaining portion of the total amount of ink to be applied for said image.

13. The apparatus of claim 12, said user control adjusting lightness (L) of said image in an L*a*b* color space.

* * * * *